US005799835A

United States Patent [19]

Gobbel

[11] Patent Number: 5,799,835

[45] Date of Patent: *Sep. 1, 1998

[54] SPRAYER EXTENSION DEVICE

[76] Inventor: Keith Gobbel, 1455 NE. 175th St., North Miami Beach, Fla. 33162

[ * ] Notice: The term of this patent shall not extend beyond the expiration date of Pat. No. 5,540,359.

[21] Appl. No.: 690,506

[22] Filed: Jul. 31, 1996

Related U.S. Application Data

[63] Continuation-in-part of Ser. No. 543,488, Oct. 16, 1995, Pat. No. 5,540,359.

[51] Int. Cl.[6] ..... B05B 15/10; B65D 83/14

[52] U.S. Cl. ..... 222/174; 222/180; 222/330; 222/402.13; 222/530; 239/281

[58] Field of Search ..... 222/174, 180, 222/330, 331, 402.13, 526, 529, 530; 239/281, 533.1, 203, 587.3

[56] References Cited

U.S. PATENT DOCUMENTS 2,555,563 6/1951 Benton ..... 222/330 X 3,259,139 7/1966 Bell et al. ..... 222/330 X 5,540,359 7/1996 Gobbel ..... 222/530 X

*Primary Examiner*—Kevin P. Shaver

*Attorney, Agent, or Firm*—Malloy & Malloy, P.A.

[57] ABSTRACT

A sprayer extension device, to be used with a spray container of the type that includes a housing and an outlet valve through which a fluid content of the spray container exits the housing, including a connector hub that has a fluid inlet connected in fluid flow communication with the outlet valve of the spray container, and an extension segment. The extension segment includes a proximal end secured to the connector hub, a free distal end that can be variably spaced from the connector hub, and a fluid conduit. The fluid conduit is structured for fluid engagement with the fluid inlet of the connector hub and an outlet nozzle disposed at substantially the distal end of the extension segment so as to permit sprayed passage of the fluid therethrough at a spaced apart distance from the connector hub and the spray container upon actuated initiation of a flow of the fluid from the spray container into the fluid inlet of the connector hub.

16 Claims, 4 Drawing Sheets

SPRAYER EXTENSION DEVICE

BACKGROUND OF THE INVENTION

The present is a Continuation-in-Part of Ser. No. 08/543,488 U.S. Pat. No. 5,540,359, Filed Oct. 16, 1995 and issuing on Jul. 30, 1996.

FIELD OF THE INVENTION

The present invention relates to a sprayer extension device to be used with a spray container so as to provide for effective, controllable, and manageable dispensing of a fluid content of the spray container at a remote, hard to reach location, and in particular to provide rapid, effective, accurate, and manageable lubrication of the guide tracks of a shutter assembly located in a hard to reach position and orientation.

DESCRIPTION OF THE RELATED ART

Aerosol and pump type spray containers are commonly and frequently implemented in a variety of household and industrial uses, and can contain a variety of fluids therein such as bug sprays, paints, and lubricants. While providing many conveniences, it has long been recognized that a significant problem associated with the use of conventional sprayer containers relates to their inability to reach out of the way locations, and especially elevated locations. In an attempt to solve this common problem, numerous devices have been provided in the related art. These devices, however, such as the handle assembly of Smart (U.S. Pat. No. 5,368,202), the spray can control apparatus of Betore et al. (U.S. Pat. No. 5,307,959), the spray work tool of Yoshitomi (U.S. Pat. No. 4,886,191), and the extension spray device of Offutt (U.S. Pat. No. 4,092,000), which are very similar with one another, while providing more accessibility to the out of the way locations, still do not provide an effective and easy to use device. In particular, the primary feature that all of these prior art inventions have in common relates to the positioning of the sprayer can at a distal most end of an elongate segment. As such, each of these devices requires the configuration of an elaborate, long range triggering mechanism which will actuate the sprayer nozzle from a substantial distance away. Accordingly, the structure and function of these known sprayer devices of the related art is to permit a user to hold the spray can somewhat close to the location to be sprayed, while the user controls the spray from a remote position. Such an approach and product configuration, however, is quite difficult to utilize effectively as it is substantially top heavy, placing all of the weight of the spray can at the end of an elongate rod and requiring that the user hold up the can from an opposite end of the pole. Naturally, if the person attempting to utilize the device does not have very strong hands and/or arms, it can be quite difficult to position the can to effectively spray. Further, in many job situations such as during the lubrication of storm shutters, the spray can must be precisely maneuvered and/or held in place and sprayed for an extended period of time, making it very difficult to hold and properly orient the spray, even for stronger individuals. Moreover, if a user must have one hand free, such as to open and close doors, windows, or shutters, the unbalanced weight distribution makes such known, top heavy assemblies difficult to use.

Turning to the art relating to the maintenance and lubrication of storm shutters, and in particular, accordion and bahama type storm shutters, it tends to be a very specialized art that often requires special technicians with special equipment. Still, one primary difficulty associated with the maintenance of these types of storm shutters, which remains despite all of the specialized techniques, involves the need to maintain upper and lower tracks of the shutters lubricated. In particular, if the shutters are not lubricated on a regular basis they can corrode/oxidize in an open orientation, or otherwise become difficult to close, such that in an emergency situation a user may not be able to shut them. Usually, the storm shutters, which are positioned on an exterior of a building, are found in very elevated, out of the way locations. Accordingly, most users find it very difficult to lubricate the shutters themselves, thereby requiring that a technician be called in. Nevertheless, even the technician must often struggle to appropriately and effectively lubricate the exterior tracks. For example, in homes or other two story buildings, the technician will generally need to utilize a ladder to climb up to the storm shutter from an exterior of the structure, and in very high, multi-story locations, such as in large buildings, the technician must precariously lean out the window and attempt to reach as high as they can. As can be expected, utilizing a ladder to reach the elevated location severely limits the range of movement a technician can reach in one location, and it can be quite dangerous if the technician seeks to stretch out and lubricate a greater area than is safely accessible from the ladder's current position. Moreover, leaning out of an elevated window, especially leaning up to an elevated, hard to reach location, can be very dangerous and naturally detracts from the concentration and care required to focus the lubricant spray within the track rather than on the walls and remaining portions of the storm shutter. As such, effective maintenance of these storm shutters can be quite expensive as it is generally impractical for an individual to lubricate the track themselves. Further, both private consumers and technicians who attempt to use the previously recited extension devices, experience substantial difficulties as they must lean the entire extension apparatus out the window and hold the heavy can precariously on the distal end of the extension.

A further drawback associated with the spray can control devices of the related art, relates to their inability to precisely focus the spraying where necessary. Generally, most triggering extension devices require large and often complicated devices to provide for appropriate holding of the spray can and actuation of its nozzle. Therefore, those devices are not easily adaptable to spray into corners, or tight locations, such as within a shutter track. In fact, this is a problem associated with the use of spray cans in a conventional fashion, and as such, has lead to the development of devices such as those recited in the patents to Palmert et al. (U.S. Pat. No. 4,958,750), Beres et al. (U.S. Pat. No. 3,395,838), and Berriochoa (U.S. Pat. No. 4,941,600). Such devices place the can in a special receptacle or container and provide an elongate flexible hose which can be more conveniently held and manipulated by a user. Unfortunately, however, such devices do not facilitate efficient and effective spraying in an out of the way locations, as their reach distance is limited by the distance to which a user can extend their arm in order to properly position the end of the flexible hose.

There is accordingly, substantial need in the art for an effective spray can extension device which can appropriately utilize conventional spray cans in order to provide for effective, accurate, safe and convenient to implement spraying at a remote location. Additionally, there is a need in the art relating to the maintenance and repair of storm shutters, such as built-in accordion or bahama type shutters, to provide an assembly which enables a worker to utilize conventionally implemented lubricants in a safe, efficient and effective way by ensuring that the lubricant spray is focused within the tracks, and by minimizing the difficulties associated with holding the can near the location to be sprayed for effectively lubricating the entire track portion and wheel assembly.

Moreover, it is also seen that in the specialized art associate with storm shutter lubrication, a worker is generally required to lubricate both upper and lower tracks, as well as interior and exterior track sections. Accordingly, it would be beneficial to provide an effective extension device capable of efficiently and preferably simultaneously spraying the multiple tracks. Further, such a device should maintain proper alignment within the track(s) as it moves therein and be quickly and easily transferred, in an aligned orientation, from one half of an accordion type shutter assembly to an opposite half, thereby ensuring complete and effective spraying.

SUMMARY OF THE INVENTION

The present invention is directed towards a spray extension device to be used with a spray container of the type that has a housing and an outlet valve through which a fluid contents of the spray container exits the housing. Specifically, the sprayer extension device includes a connector hub having a fluid inlet. The fluid inlet is specifically structured and disposed to be connected in fluid flow communication with the outlet valve of the spray container, thereby ensuring that all fluid exiting the spray container enters the sprayer extension device therethrough.

Further, the sprayer extension device includes a generally elongate, generally rigid extension segment. The extension segment, as structured, includes a proximal end and a free distal end. Moreover, the proximal end is secured to the connector hub, and a free distal end is structured to be variably spaced from the connector hub. Also included with the extension segment is a fluid conduit. The fluid conduit has a first end and a second end, with the first end being structured for fluid engagement with the fluid inlet of the connector hub. As such, fluid exiting the spray container enters the fluid conduit therethrough from the fluid inlet.

Additionally, the sprayer extension device includes an outlet nozzle secured to the extension segment, at substantially the free distal end thereof. The outlet nozzle is disposed in fluid flow communication with the second end of the fluid conduit so as to permit sprayed passage of fluid from the spray container therethrough at a location which is substantially spaced apart from the connector hub and the spray container itself. Finally, actuation means are included and are structured and disposed to permit a user to initiate a flow of the fluid from the spray container and into the fluid inlet of the connector hub for appropriate spraying out the outlet nozzle.

The present invention also relates to a storm shutter lubrication assembly. The storm shutter lubrication assembly is structured to be used with a spray container, which contains a quantity of lubricant fluid and includes a housing and an outlet valve through which the lubricant fluid exits the housing. Turning specifically to the shutter lubrication assembly, it includes a connector hub with a fluid inlet structured and disposed to be connected in fluid flow communication with the outlet valve of the spray container. Further, the assembly includes at least two extension segments, each of which has a proximal end secured to the connector hub and a free distal end structured to be variably spaced from the connector hub.

Also included within each of the extension segments is a fluid conduit having a first end and a second end. The first end of the fluid conduit is structured for fluid engagement with the fluid inlet of the connector hub, thereby providing for the passage/flow of fluid through the fluid conduit. Fluid directed through the fluid conduit flows to an outlet nozzle connected in fluid flow communication with the second end of the fluid conduit. In particular, an outlet nozzle is secured to each of the extension segments, at substantially the distal end thereof, and is structure to permit sprayed passage of the fluid therethrough at a spaced apart distance from the connector hub and the sprayed container. As such, a user is able to simultaneously spray interior and exterior track sections.

Additionally, the shutter lubrication assembly of the present invention includes clamp means. The clamp means are structured and disposed to secure the connector hub, and the sprayer can, to a vertical edge of the storm shutter. As such, the clamp means maintain the extension segments in desired alignment with the vertical edge of the storm shutter, which in turn maintains the outlet nozzles positioned in a corresponding horizontal track of the storm shutter during operational use of the shutter lubrication assembly.

It is an object of the present invention to provide a sprayer extension device which provides for convenient and manipulable spraying of a fluid contents of a conventional disposable can at a remote, out of the way location.

A further object of the present invention is to provide a sprayer extension device capable of simultaneously spraying multiple locations including interior and exterior storm shutter track sections, or upper and lower storm shutter tracks.

Another object of the present invention is to provide a sprayer extension device structured to help a user maintain proper leverage and therefore positioning of the outlet nozzle during use.

An additional object of the present invention is to provide a sprayer extension device structured to help a user maintain proper alignment of the outlet nozzle along an elongate shutter track.

Still another object of the present invention is to provide a sprayer extension device structured which facilitates aligned transfer from one half of a retractable storm shutter panel to an opposite half.

Also an object of the present invention is to provide a sprayer extension device which is properly balanced and is easy to hold for extended periods of time when being utilized to precisely spray fluid at a remote location.

An additional object of the present invention is to provide a sprayer extension device which permits facilitated spraying at an elevated, hard to reach location as well as a low, concealed location behind a large object.

A further object of the present invention is to provide a sprayer extension device which provides for precise and accurate spraying at an extended, hard to reach location.

An object of the present invention is to provide a sprayer extension device which is capable of conveniently and effectively spraying in variable and/or multiple directions.

Another object of the present invention is to provide a sprayer extension device which is substantially convenient to store when not in use, but which is easy to implement and extend to a desired extended orientation when needed.

An additional object of the present invention is to provide a sprayer extension device which is easy and convenient to hold and implement by a user.

Yet another object of the present invention is to provide a sprayer extension device which can be effectively secured to a support surface so as to provide for properly aligned spraying and extension.

Another object of the present invention is to provide a storm shutter lubrication assembly which provides for the facilitated lubrication of a storm shutter track assembly.

An additional object of the present invention is to provide a storm shutter lubrication assembly which provides for precise and accurate spraying of a fluid lubricant into a track of the shutter assembly in a hard to reach location.

Another object of the present invention is to provide a storm shutter lubrication assembly which facilitates aligned movement of a sprayer nozzle within a track of a storm shutter so as to provide facilitated lubrication of the entire track assembly.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Shown throughout the Figures, the present invention is directed towards a sprayer extension device, generally indicated as 10. Preferably, the sprayer extension device 10 is structured for use with a spray container A of the type which includes a housing B that contains a quantity of fluid, and an outlet valve C through which the quantity of fluid exits the housing B. As such, the spray container A is preferably an aerosol type container that includes any of a variety of items, such as bug spray, cleansing fluid, or lubricating fluid, as is the case in a preferred application to be described in greater detail subsequently. Nevertheless, it should be understood that the spray container A may be of the type which requires a vacuum/pump action to draw out the fluid, said embodiment not being shown for clarity.

Figure 1:
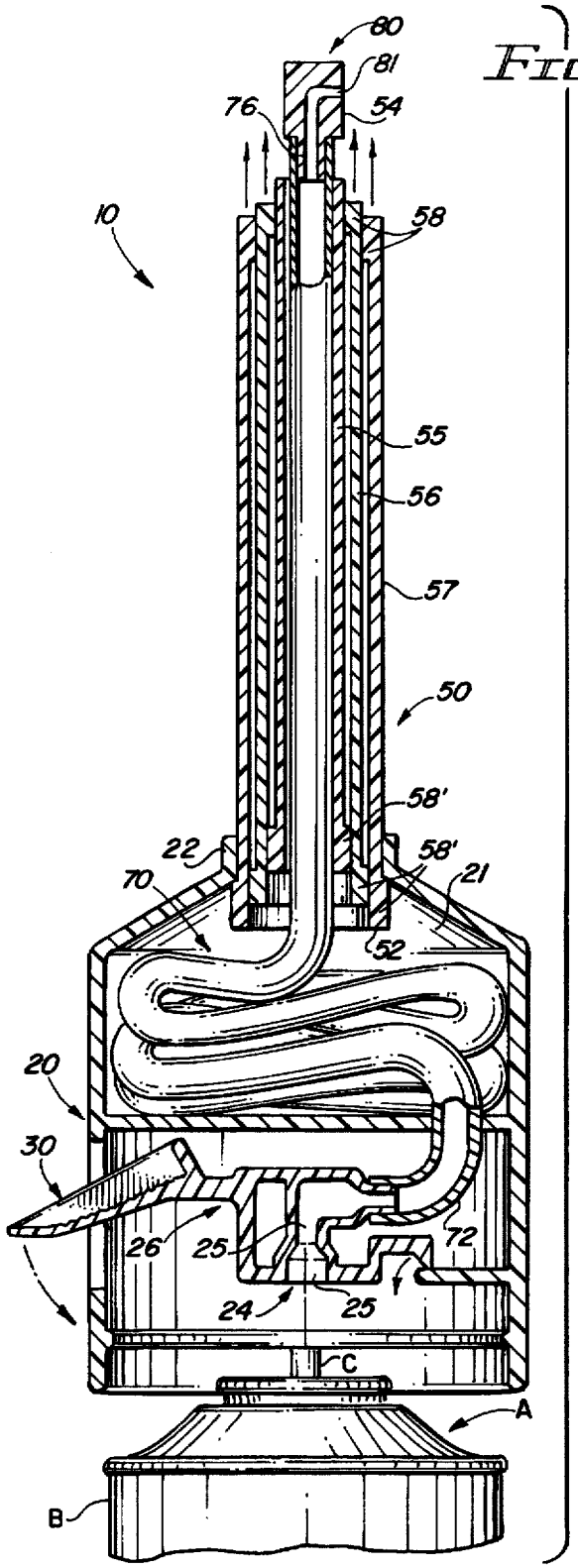
FIG. 1 is a side cross-sectional view of an embodiment of the sprayer extension device of the present invention.

Turning specifically to a preferred embodiment of the sprayer extension device 10, as illustrated in FIG. 1, the sprayer extension device 10 includes a connector hub 20. The connector hub 20, which may be sized to be snap-fitted on the spray container A much like an ordinary lid of the spray container A, includes a fluid inlet 24 disposed therein. The fluid inlet 24 is structured and disposed to be connected, in fluid flow communication, with the outlet valve C of the spray container A. While the fluid inlet may be structured for connection with a conventional spray nozzle that is normally disposed on the outlet valve C of most spray containers A, in the preferred embodiment, the fluid inlet 24 is structured to snugly fit directly over the outlet valve C. As such, the fluid inlet 24 is preferably rigidly or expandably sized to correspond a particular, common dimension outlet valve C, and/or close variations therefrom. Alternatively, however, as illustrated in FIG. 1, the fluid inlet 24 may be structured to fit varying size outlet nozzles C, such as through the inclusion of a double tiered configuration having two or more sized nozzle receiving areas 25 and 25' defined therein and into which the outlet valve C is selectively fitted to provided the needed secure fit. Preferably, the fluid inlet 24 will provide a snug, substantially airtight fit about the outlet valve C, thereby preventing leakage and ensuring that substantially all of the fluid being emitted from the spray container A enters the fluid inlet 24.

Secured with the connector hub 20 is at least one extension segment 50. The extension segment 50 includes a proximal end 52 that is secured to the connector hub, and a free distal end 54 which is structured to be variably spaced from the connector hub. Although a single, elongate tubular member may be employed, in the preferred embodiment of the present invention, the extension segment 50 includes at least two or more interlocked, telescoping members 55, 56, and 57. In this regard, it is understood that the number and size of the two or more interlocked, telescoping members will determine the overall extension length of the extension segment 50 and the number of interlocked, telescoping members which are necessary to extend the extension segment 50 to a desired length. Although any of a variety of structures may be implemented to provide for effective interlocking, such as the tapering of opposite ends of the telescoping members, in the preferred embodiment, and for ease of manufacture, each of the interlocked, telescoping members 55 and 56 will include inward and outwardly extending flanges 58 and 58'. The flanges 58 and 58' are structured to extend opposite directions from one another at opposite ends of each of the interlocked, telescoping members 55, 56, and 57. As such, the flanges 58 and 58' are structured and disposed to abut one another upon extension of the interlocked, telescoping members to a maximum spacing, thereby preventing accidental separation of the interlocked, telescoping members from one another. Additionally, the flanges 58 and 58' may be structured to be snap fitted, or otherwise secured with one another in order to provide a snug, fitted, interlocked engagement which will not easily collapse during use, but which is retractable when desired. It is therefore seen, that one or more of the interlocked, telescoping members 55, 56, and 57 may be extended at one time so as to vary the desired overall length of the extension segment 50.

Further included in the extension segment 50 is a fluid conduit 70. The fluid conduit 70 includes a first end 72 and a second end 76 and is structured to permit fluid flow therethrough. Although the fluid conduit 70 may be molded directly into the connector hub 20 and the extension segment 50, such that the interlocked, telescoping members 55, 56, and 57 themselves act as the fluid conduit, in the preferred embodiment the fluid conduit 70 includes an elongate, generally flexible tube. As such, the fluid conduit 70 can be structured to be replaced or interchanged so as to accommodate varying types of liquids without contamination. The first end 72 of the elongate flexible tube 70 is structured to engage the fluid inlet 24 in the connector hub 20 such that fluid passing through the fluid inlet 24 passes into the elongate flexible tube 70. Conversely, the second end 76 of the elongate flexible tube 70 is disposed so as to terminate at the free distal end 54 of the extension segment 50.

Figure 2:
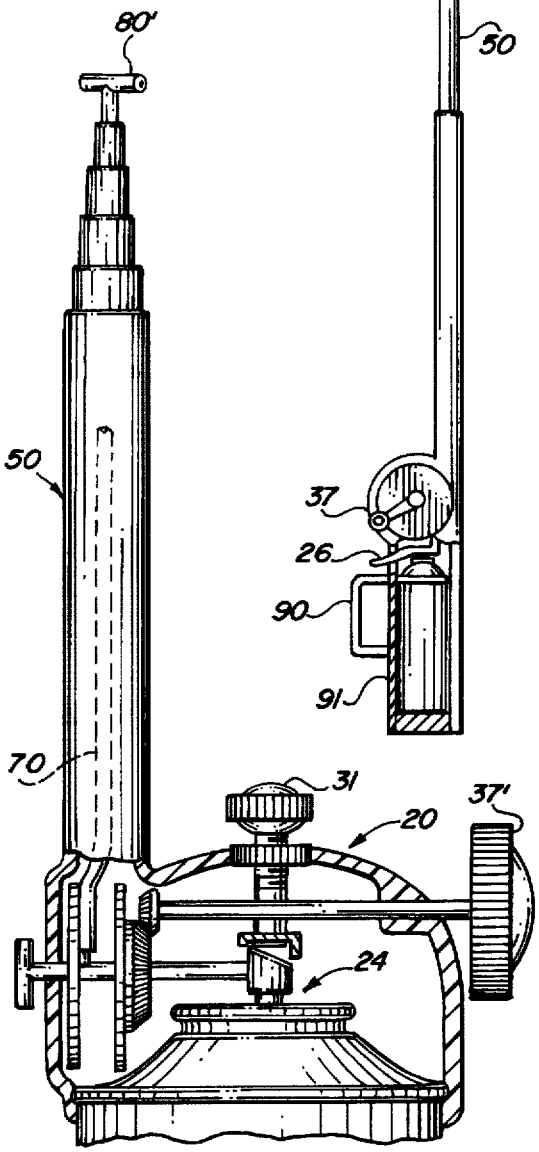
FIG. 2 is a side view of another embodiment of the sprayer extension device of the present invention.
Figure 6:
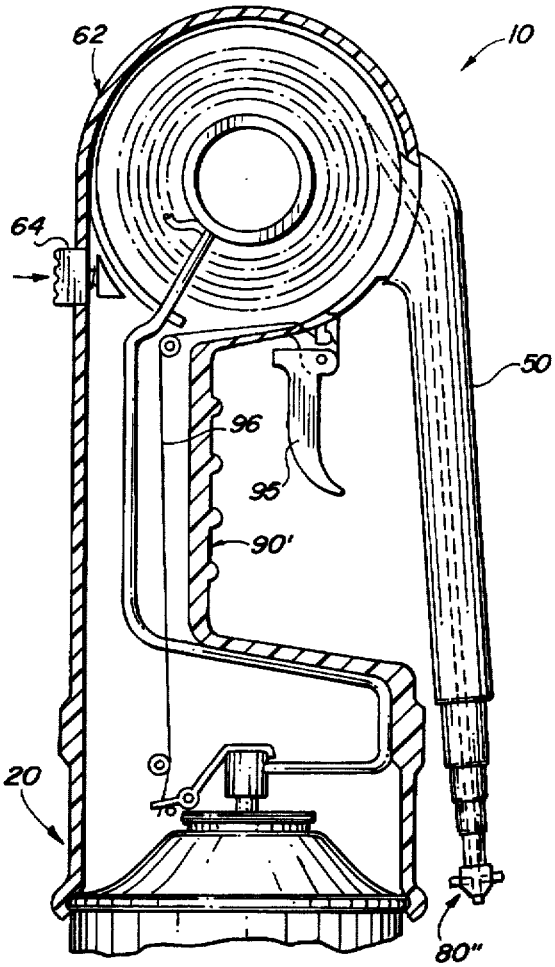
FIG. 6 is a side view of yet another embodiment of the sprayer extension device of the present invention.
Figure 5:
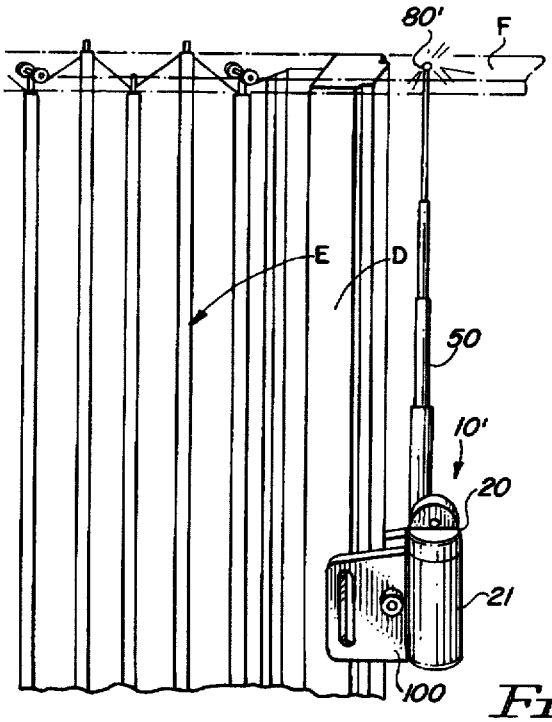
FIG. 5 is a side view of the sprayer extension device implementing the exterior handle of FIG. 4 for use in lubricating a shutter assembly.

In particular, the second end 76 of the fluid conduit 70 is preferably to be connected in fluid flow communication with an outlet nozzle 80. The outlet nozzle 80 is secured to the extension segment 50, at substantially its free distal end 54. As such, fluid that passes through the fluid conduit 70 from the fluid inlet 24 is structured to be sprayed out through the outlet nozzle 80. Further, as illustrated in FIG. 1, a first embodiment of the outlet nozzle 80 includes a single outlet opening 81. In alternative embodiments, however, as illustrated in FIGS. 2 and 6, the conventional outlet nozzle 80 may be replaced with a two outlet opening outlet nozzle 80', a three outlet opening outlet nozzle 80", or any other combination as is necessary to properly and effectively permit sprayed passage of fluid therethrough, at a spaced apart distance from the connector hub 20.

Returning to the extension segment 50, it is understood that it can be extended to a fully or partially extended distance in many of a variety of manners. For example, in a first preferred embodiment the extension segment 50 is extended merely by pulling on the free distal end 54 or the outlet nozzle 80, which is connected with the free distal end 54 of the extension segment 50, and thereby pulling out all of the interlocked, telescoping members 55, 56, and 57 until the desired locked extended orientation is achieved. In such an embodiment excess portions of the fluid conduit 70, which are needed when the extension segment 50 is in its fully extended position, are conveniently retained within a containment area 21 of the connector hub 20. In this regard, the fluid conduit 70 may merely be folded into the containment area 21 of the connector 20, or may be effectively wound around a reel member 36, such as that illustrated in FIG. 2. Turning to the reel member 36, it should be noted that the reel member 36 may be vertically or horizontally positioned in any conventional manner. Additionally, the reel member 36 may be connected with an exterior handle 37 or 37'. The exterior handle 37 or 37' can be connected directly with a central axis of the reel member 36, as in FIG. 3, or can be connected to the reel member 36 by a number of gear members. Nevertheless, the exterior handle 37 or 37', is structured in any conventional manner such that when it is rotated in a first direction the extension segment 50 is caused to retract, and when rotated in a second direction the extension segment 50 is fully or partially extended. In the preferred embodiment, the elongate flexible tube 70 is secured to the outlet nozzle 80 and is structured of a material that has sufficient rigidity such that upon rotation of the reel member 36 the flexible tube 70 is unreeled and functions to push up on the outlet nozzle 80. As the outlet nozzle 80 is connected with the extension segment, when the flexible tube 70 pushes up the outlet nozzle 80, the distal end 54 of the extension segment 50 is also pushed up into a spaced apart orientation from the connector hub 20. Furthermore, in this embodiment, the flexible tube 70 functions both to extend the extension segment 50 to the desired length, and to prevent accidental retraction of the extension segment 50. In this regard, the reel member 36 may include a separate locking mechanism to prevent the reel from rotating into a retracting orientation.

So as to initiate a pressurized flow of fluid from the spray container A into the fluid inlet 24 of the connector hub 20, actuation means are included. In the preferred embodiment, wherein the spray container A is an aerosol type container, the actuation means preferably include a nozzle member 26 that incorporates the fluid inlet 24 and is disposed over the outlet valve C of the spray container A. The nozzle member 26 is specifically structured to be pushed or otherwise displaced by a user in order to correspondingly displace the outlet valve C of the spray container A and result in a pressurized emission of fluid from the outlet valve C into the fluid inlet 24 of the connector hub 20. Also, in the preferred embodiment illustrated in FIGS. 1 and 3, a thumb actuation member 30 is disposed to protrude from the connector hub and thereby provide for easy pushing by a user. In particular, by depressing the thumb portion 30 the nozzle member 26 pivots relative the connector hub 20 and accordingly displaces the outlet nozzle C to initiate the pressurized flow. It can be seen, however, that alternative actuation means, such as a conventional sprayer nozzle connected with the fluid conduit 70 and disposed such that a user may merely insert their finger into the connector hub 20 for appropriate displacement of the outlet valve C may also be implemented. Further, in yet another embodiment illustrated in FIG. 2, a screwed down clamping mechanism 31 is included to push down on the outlet nozzle and provide for continuous sprayed emission through the outlet nozzle 80. Moreover, the spray container A may include a rechargeable aerosol can so as to facilitate commercial use and easy refilling from a bulk source, or may include a non-aerosol container containing a nonpressurized fluid. In such an embodiment, the actuation means may include a pump type actuation means which draws fluid from a bottom of the container.

Because it is often desirable to direct the spray emissions in different directions after the extension segment 50 has been fully extended, in the preferred embodiment of the spray extension device 10 of the present invention, the extension segment 50 is structured to rotate relative to the connector hub 20. In particular, as the outlet nozzle 80 is connected with the distal end 54 of the extension segment 50, rotation of an outermost interlocked, telescoping member 57 relative to the connector hub 20 results in corresponding rotation of the outlet nozzle 80. Furthermore, since all of the telescoping members are connected with one another, rotating a first or outer most one of the telescoping members 57 results in corresponding rotation of all of the telescoping members. Accordingly, because in the preferred embodiment of FIG. 1 the outer most interlocked, telescoping member 57 is retained within the connector hub by its protruding flange 58' engaging a collar 22 of the connector hub 20, free relative rotation therebetween is permitted without risk of removal of the extension segment 50 from its secured engagement with the connector hub 20.

Turning to the embodiment of FIG. 6, the extension segment 50 may also be structured to pivot relative to the connector hub 20. As such, the outlet nozzle 80 may not only be conveniently positioned to reach high, out of the way location, but can also be positioned to reach a low or horizontal out of the way location, such as behind an appliance for the spraying of a bug spray, or over a long or wide furniture article. Although it is understood that any of a number of interconnections between the extension segment 50 and connector hub 20 may be effectively employed to provide for the pivotal securing, in the illustrated embodiment of the present invention, the extension segment 50 includes an interior engagement hub 60 disposed within a reel compartment 62 of the connector hub 20. In this embodiment, the reel compartment 62 has an exterior slot through which the extension segment 50 extends from its interior engagement hub 60. As such, as the engagement hub 60 rotates within the reel compartment 62 of the connector hub 20, relative pivotal movement of the entire extension segment 50 and the outlet nozzle 80 is achieved. Also in this embodiment, a locking mechanism 63 may be implemented so as to lock the extension segment 50 in a particular pivoted orientation relative to the connector hub 20. While various locking mechanisms, such as a pin, spring, clamp or wedge may be employed, in the illustrated embodiment of FIG. 6 the locking mechanism 64 includes a buffer element structured to be exteriorly pushed into temporary or fixed abutment with the engagement hub 60 of the extension segment 50, thereby non-pivotally securing it in its present location.

Figure 3:
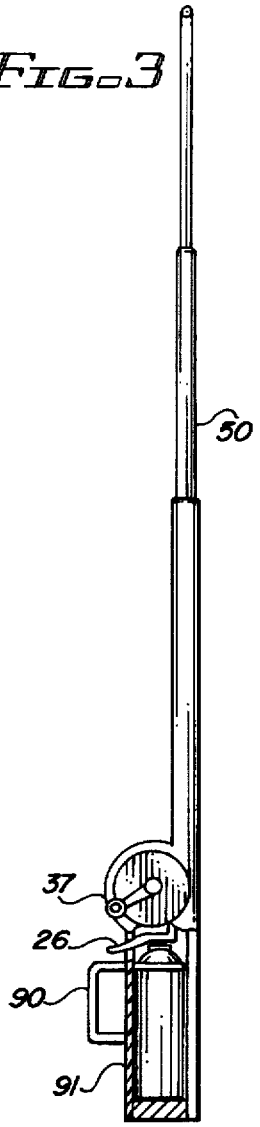
FIG. 3 is a fully extended side view of a further embodiment of the sprayer extension device of the present invention.

Although a spray container A including the sprayer extension device 10 of the present invention can be conveniently held in a user's hand, in much the same way as the spray container A is conventionally held and actuated, in a preferred embodiment of the present invention, such as that illustrated in FIGS. 3, 4, 5, and 6, the connector hub 20 may also include handle means 90. Specifically, the handle means 90 are structured to facilitate holding of the connection hub 20, and spray container A secured thereto, in a manner that is easy to manipulate for appropriate positioning of the extended nozzle 80, and easy hold for effective actuation of the actuation means. As can be seen, the handle means 90 can take on any of a number of conventional configurations, such as a handle loop which extends from the connection hub 20, or an entire contained housing 91, as illustrated in FIG. 3, which completely contains the spray container A and has a conventional mug type handle 90 protruding from an exterior surface thereof. Turning to FIG. 6, however, the handle means 90' may be structured to protrude from an upper end of the connector hub 20 to further facilitate maintenance of the center of gravity of the overall assembly at the user's hand, and thereby improve operational balance when extending the outlet nozzle 80 to a desired, hard to reach location. In such an embodiment of the handle means 90', the actuation means may include conventional actuation means 26, which will require a user to implement two hands, or can include a trigger type actuation means 95 which is connected with the fluid inlet 24 by a cable or wire 96 such that appropriate pulling of the trigger actuation means 95 results in corresponding pulling of the cable 96 and displacement of the outlet valve C. Similarly, in the embodiments of FIGS. 8 and 9, the handle means 90'" and 90"" may extend upwardly from the connector hub 20 for an increased leverage grip. Moreover, in the embodiment of FIG. 9, a thumb actuated button 30' may be incorporated at a top of the easily grippable handle means 90"".

Figure 7:
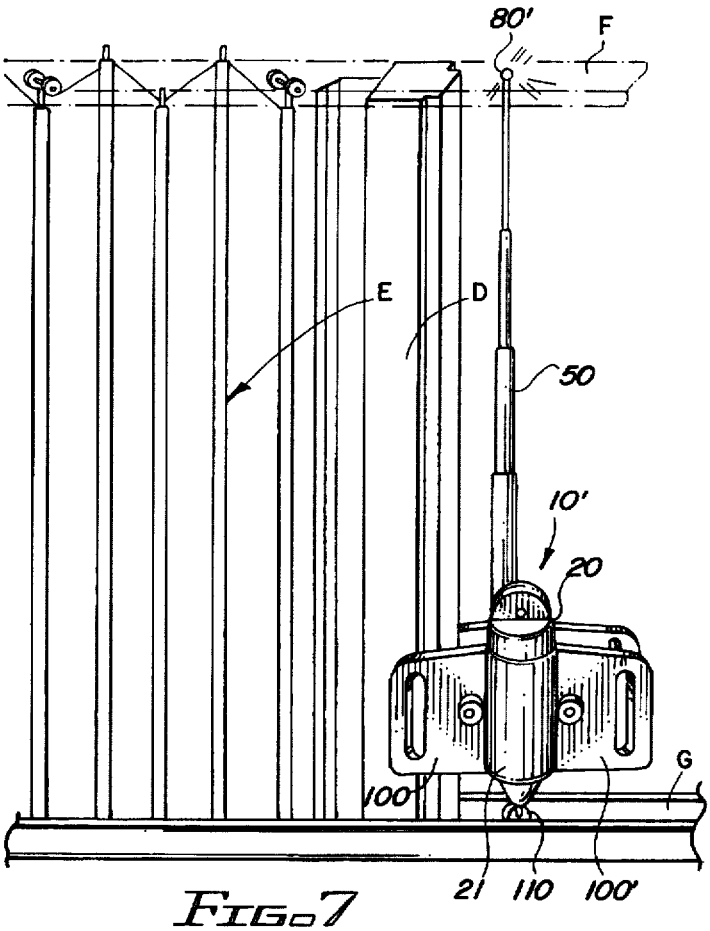
FIG. 7 is a side view of an embodiment of the sprayer extension device of the present invention which incorporates two clamp means for securement to the vertical edge of the storm shutter and a guide extension.

In the preferred application of the present invention, the sprayer extension device 10 is structured to be a storm shutter lubrication assembly 10' which lubricates the bearing track or wheels of a conventional accordion or bahama type storm shutter assembly. In this embodiment, the storm shutter lubrication assembly 10' further includes clamp means 100 that are structured and disposed to secure the connector hub 20, and the sprayer can A to an adjacent support surface such as a vertical edge D of the accordion type shutter E. As such, the clamp means 100 maintain the extension segment 50 in a desired alignment with the vertical edge D such that when the extension segment 50 is extended the outlet nozzle 80 is appropriately maintained in the horizontal track F that retains the shutter panel E slidably therein during use. In particular, most technicians, when lubricating a storm shutter, will tend to spray a substantial quantity of lubricating fluid into the track F, while the shutter E is opened and closed to effectively distribute the lubricating fluid over all of the bearings and wheels of the storm shutter E. Accordingly, it is substantially beneficial to provide an accurate spray stream into the horizontal track F while the shutter is being opened and closed. In conventional circumstances, however, it is very difficult to accurately direct the lubricating spray into the horizontal track F, especially when it is in an out of the way, often elevated location on an exterior of a structure. Utilizing the storm shutter lubrication assembly 10' of the present invention which clamps directly to the shutter, a technician is able to effectively and accurately direct the lubrication spray into the horizontal track F, while providing for simultaneous opening and closing of the horizontal shutter E. Additionally, as illustrated in the embodiment of FIG. 7, a pair of clamp means 100 and 100' may be included and extend in opposite directions. Such an embodiment is especially beneficial with accordion shutters that lock at a center mate, because one half of the shutter cannot slide the entire length of the horizontal track F. Accordingly, utilizing the embodiment of FIG. 7, once one half of the track F has been lubricated, the opposing half of the shutter is slid into locked engagement with the second of the clamp means 100', and the first clamp means 100 is released to permit continued, continuously aligned lubrication of the horizontal track F in the other half of the shutter E rides. Also, in either embodiment, a multiple outlet opening outlet nozzle 80 is preferred to provide for more complete and effective lubrication of the entire horizontal track F.

Figure 10:
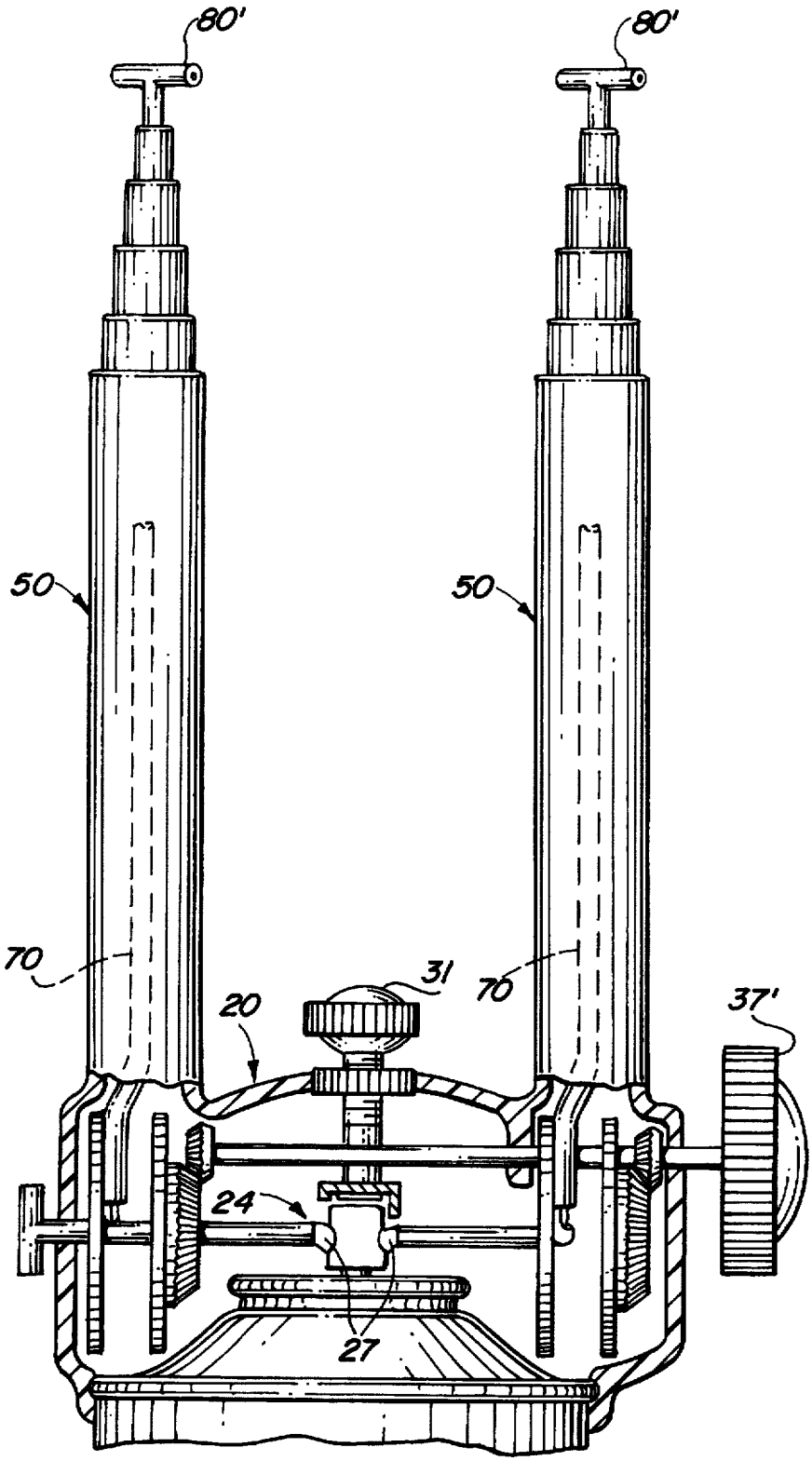
FIG. 10 is an elevated, side view of the sprayer extension device of the present invention including two extension segments.

Additionally, turning to FIG. 10, multiple, and preferably two, extension segments 50 may be included. In this embodiment, each of the extension segments 50 is preferably independently extendable so as to permit dual use only when necessary. Moreover, the outlet nozzles 80 of each extension segment 50 are generally spaced form one another in this embodiment so as to facilitate simultaneous spraying of both interior and exterior track segments of the storm shutter E in a single pass. Similarly, when utilizing the dual extension segment 50 embodiment, with the pivoting embodiment of FIG. 6, it is seen that one of the extension segments 50 is able to spray an upper track, while the second of the extension segments 50 sprays the lower track. In this embodiment, each of the extension segments 50 preferably includes a fluid conduit 70 connected with an adapted fluid inlet 24' which splits the fluid flow in opposing directions 27 to supply the fluid conduits 70 in each extension segment 50. It should be noted that these dual extension segment 50 embodiments need not be limited to storm shutter lubrication applications alone.

Figure 8:
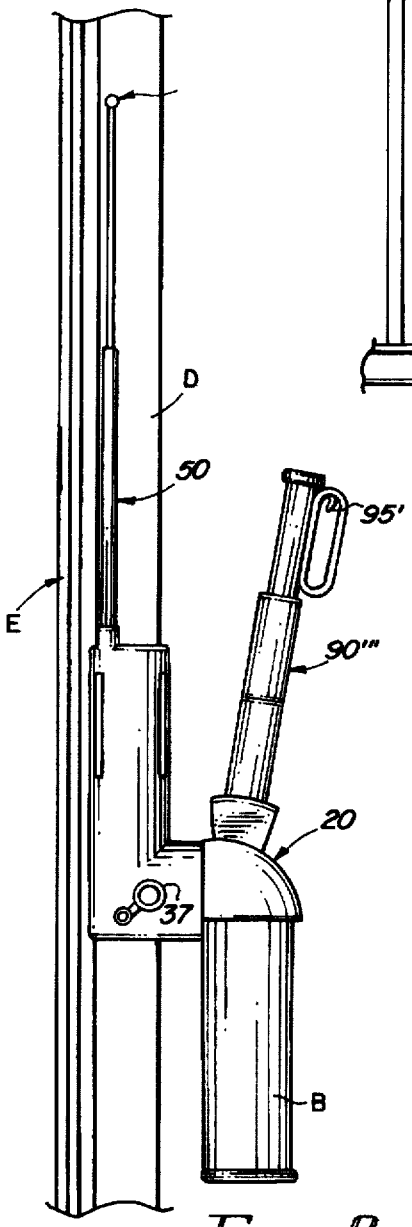
FIG. 8 is a side view of still another embodiment of the sprayer extension device of the present invention illustrating an alternative, angled handle means.
Figure 9:
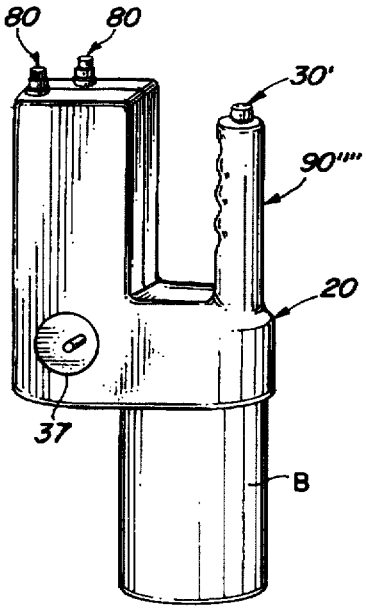
FIG. 9 is a side view of the sprayer extension device of the present invention illustrating another alternative handle means.

Looking once again to the embodiment of FIG. 8, this embodiment is particularly beneficial when the shutters E tend to wobble as they open and close, thereby making it difficult to maintain the entire track exposed to the spray from the outlet nozzle 80. In this embodiment, an extendable, angled handle 90'" is included, with a trigger assembly 95' disposed at a top end thereof. As such, a user, preferably after clamping the device in place, can pull back on the handle means 90'", maintaining a desired alignment, and in turn pulling back on and exposing the tracks to be sprayed as the shutter E is opened and closed. Alternatively, however, a guide extension 110, as illustrated in FIG. 7, may be configured to extend downwardly and ride within a lower track G in order to maintain proper alignment as the shutter opens and closes to achieve even and complete lubrication.

Figure 4:
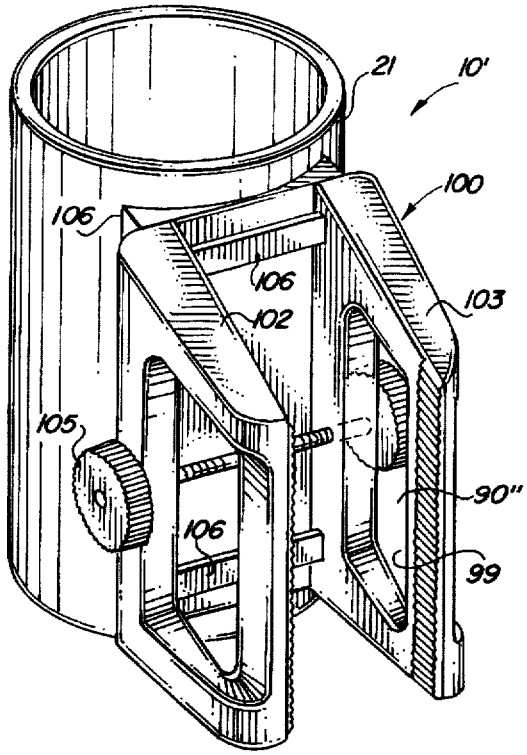
FIG. 4 is an isolated perspective view of an exterior handle portion of the sprayer extension device of the present invention.

Although the clamp means 100 can take on any of a number of conventional clamp type configurations, such as a spring clamp, in the preferred embodiment, the clamp means 100 includes at least one pair of confronting clamp members 102 and 103 which are clamped about the center mate of the storm shutter E. These confronting clamp members 102 and 103 are structured to be adjustably spaced relative to one another, either by a biasing means, or as illustrated in FIG. 4, by a threaded tightening screw 105. In this embodiment, the threaded tightening screw 105 is structured to be rotated and appropriate engaged threads on the confronting clamp members 102 and 103, thereby threadedly driving the confronting clamp members 102 and 103 towards or apart from one another within a pair of spaced tracks 106 that maintain aligned movement. Additionally, in the preferred embodiment of the clamp means 100, they will also include handle means 90" formed therein. In particular, each of the confronting clamp members 102 and 103 will preferably include a handle opening 99 formed therein and structured to permit passage of a user's hand therethrough. Accordingly, when not clampingly secured to the center mate of the shutter assembly E, the clamp means 100, enable the connector hub 20 and sprayer can A to be effectively held and manipulated for appropriate spraying.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To be used with a spray container including a housing and an outlet valve through which a fluid content of the spray container exits the housing, a sprayer extension device comprising:

a connector hub, said connector hub including a fluid inlet structured and disposed to be connected in fluid flow communication with the outlet valve of the spray container, at least one extension segment, said extension segment including a proximal end secured to said connector hub and a free distal end structured to be spaced from said connector hub, said extension segment including a fluid conduit having a first end and a second end, said first end of said fluid conduit being structured for fluid engagement with said fluid inlet of said connector hub, an outlet nozzle, said outlet nozzle being disposed at substantially said distal end of said extension segment, and being in fluid flow communication with said second end of said fluid conduit so as to permit sprayed passage of the fluid therethrough at a spaced apart distance from said connector hub and the spray container, and actuation means structured and disposed to initiate a flow of the fluid from the spray container and into said fluid inlet of said connector hub.

2. A sprayer extension device as recited in claim 1 wherein said first end of said fluid conduit is integrally formed with said fluid inlet of said connector hub.

3. A sprayer extension device as recited in claim 1 including two of said extension segments.

4. A sprayer extension device as recited in claim 3 wherein each of said extension segments includes one of said fluid conduits connected in fluid engagement with said fluid inlet of said connector hub.

5. A sprayer extension device as recited in claim 3 wherein at least one of said extension segments is structured to pivot between an upwardly extended orientation and a downwardly extending orientation.

6. A sprayer extension device as recited in claim 3 wherein each of said extension segments is structured to be substantially retractable.

7. A sprayer extension device as recited in claim 1 further including a guide extension structured to ride within a shutter track and maintain aligned, sliding positioning of said outlet nozzle in a desired location during use.

8. A sprayer extension device as recited in claim 7 wherein said guide extension extends downwardly.

9. A sprayer extension device as recited in claim 1 wherein said connection hub includes handle means structured and disposed to facilitate the holding of said connection hub and the spray container secured thereto.

10. A sprayer extension device as recited in claim 9 wherein said handle means are angled away from said connector hub so as to facilitate proper alignment of said extension segment.

11. A sprayer extension device as recited in claim 1 further including clamp means structured and disposed to secure said connector hub and the sprayer can to an adjacent support surface so as to maintain said extension segment in a desired alignment with the support surface.

12. A sprayer extension device as recited in claim 11 wherein said clamp means are structured and disposed to secure said connector hub and the sprayer can to a vertical edge of a storm shutter so as to maintain said extension segment in a desired alignment with the vertical edge of the storm shutter and so as to maintain said outlet nozzle in a horizontal track, which retains a shutter panel slidably therein, during use.

13. A sprayer extension device as recited in claim 12 including two of said clamp means disposed in generally opposite relation from one another, a first of said clamp means being structured and disposed to secure said connector hub and the sprayer can to the vertical edge of the storm shutter and a second of said clamp means being structured and disposed to secure said connector hub and the sprayer can to an opposite vertical edge of the storm shutter.

14. To be used with a spray container including a housing and an outlet valve through which a fluid content of the spray container exits the housing, a storm shutter lubrication device comprising:

a connector hub, said connector hub including a fluid inlet structured and disposed to be connected in fluid flow communication with the outlet valve of the spray container, at least two extension segments, each of said extension segments including a proximal end secured to said connector hub and a free distal end structured to be variably spaced from said connector hub, each of said extension segments further including a fluid conduit having a first end and a second end, said first end of said fluid conduit in each of said extension segments being structured for fluid engagement with said fluid inlet of said connector hub, an outlet nozzle, said outlet nozzle being disposed at substantially said distal end of each of said extension segments, and being in fluid flow communication with said second end of said fluid conduit so as to permit sprayed passage of the fluid therethrough at a spaced apart distance from said connector hub and the spray container, and actuation means structured and disposed to initiate a flow of the fluid from the spray container and into said fluid inlet of said connector hub.

15. A storm shutter lubrication device as recited in claim 14 wherein at least one of said extension segments is structured to pivot between an upwardly extended orientation and a downwardly extending orientation.

16. A storm shutter lubrication device as recited in claim 14 further including clamp means structured and disposed to secure said connector hub and the sprayer can to a vertical edge of a storm shutter so as to maintain each of said extension segments in a desired alignment with the vertical edge of the storm shutter and so as to maintain said outlet nozzle of each of said extension segments in a horizontal track, which retains a shutter panel slidably therein, during use.

* * * * *